US010092997B2

(12) United States Patent
Watanabe

(10) Patent No.: US 10,092,997 B2
(45) Date of Patent: Oct. 9, 2018

(54) GRINDING WHEEL

(71) Applicant: JTEKT CORPORATION, Osaka (JP)

(72) Inventor: Akira Watanabe, Chiryu (JP)

(73) Assignee: JTEKT CORPORATION, Osaka-shi (JP)

( * ) Notice: Subject to any disclaimer, the term of this patent is extended or adjusted under 35 U.S.C. 154(b) by 40 days.

(21) Appl. No.: 15/209,174

(22) Filed: Jul. 13, 2016

(65) Prior Publication Data

US 2017/0014972 A1 Jan. 19, 2017

(30) Foreign Application Priority Data

Jul. 16, 2015 (JP) ..... 2015-142269

(51) Int. Cl.

| | |
|---|---|
| ***B24D 5/14*** | (2006.01) |
| ***B24D 7/02*** | (2006.01) |
| ***B24D 7/14*** | (2006.01) |
| *B24D 7/18* | (2006.01) |
| *B24B 5/42* | (2006.01) |

(52) U.S. Cl.

CPC ..... *B24D 7/02* (2013.01); *B24D 7/14* (2013.01); *B24B 5/42* (2013.01); *B24D 5/14* (2013.01); *B24D 7/18* (2013.01)

(58) Field of Classification Search

CPC ... B24D 7/02; B24D 7/14; B24D 7/18; B24D 5/14; B24D 5/123; B24B 5/01; B24B 5/42

See application file for complete search history.

(56) References Cited

U.S. PATENT DOCUMENTS 5,888,129 A * 3/1999 Neff ..... B24D 7/14 451/541

FOREIGN PATENT DOCUMENTS

JP 11-188640 7/1999
JP 11188640 A * 7/1999

* cited by examiner

*Primary Examiner* — Joseph J Hail
*Assistant Examiner* — J Stephen Taylor
(74) *Attorney, Agent, or Firm* — Oblon, McClelland, Maier & Neustadt, L.L.P.

(57) ABSTRACT

A grinding wheel includes a disc-like member and a grinding stone layer disposed on an outer peripheral surface of the disc-like member. A grinding surface of the grinding stone layer includes a cylinder grinding surface, end grinding surfaces, and corner grinding surfaces. The grinding stone layer includes a cylindrical-portion grinding stone layer including a part of the corner grinding surfaces and the cylinder grinding surface, and end grinding stone layers including the remaining part of the respective corner grinding surfaces and the respective end grinding surfaces and having a property different from a property of the cylindrical-portion grinding stone layer. Joint surfaces are each formed by joining a boundary surface of the cylindrical-portion grinding stone layer and a boundary surface of the end grinding stone layer such that the boundary surfaces have a preset inclination α to an axis of rotation.

2 Claims, 4 Drawing Sheets

GRINDING WHEEL

INCORPORATION BY REFERENCE

The disclosure of Japanese Patent Application No. 2015-142269 filed on Jul. 16, 2015 including the specification, drawings and abstract, is incorporated herein by reference in its entirety.

BACKGROUND OF THE INVENTION

1. Field of the Invention

The invention relates to a grinding wheel.

2. Description of the Related Art

Grinding stones are conventionally used to grind journals, crank pins, and the like for an automotive crank shaft. See, for example, Japanese Patent Application Publication No. H11-188640 (JP H11-188640 A). A grinding stone disclosed in JP H11-188640 A has a disc-like member forming a grinding wheel and a grinding stone. The grinding stone is provided on an outer peripheral surface of the disc-like member, includes two types of grinding stone layers with different properties, and is divided into chips. Specifically, during grinding, high grinding resistance is offered at opposite end corners of the outer peripheral surface of the disc-like member in the direction of an axis of rotation and on opposite end surfaces of the outer peripheral surface. Thus, in these areas, a grinding stone layer is provided which is formed of grinding grains with a large grain size and which is unlikely to be worn away. No high grinding resistance is generated in a cylindrical portion between the opposite end corners of the outer peripheral surface. Thus, in this area, a grinding stone layer is provided which is formed of grinding grains that have a small grain size and are likely to worn away and that are expected to achieve high finishing accuracy.

In the above-described grinding stone, the two grinding stone layers are laminated to each other so as to have a joint surface in a direction orthogonal to the axis of rotation of the grinding wheel; one of the grinding stone layers is located at the end corners and on the end surfaces that involve high grinding resistance and that are likely to be significantly worn away, and the other grinding stone layer is located on the cylindrical portion that involves low grinding resistance and that is unlikely to be worn away. The grinding stone layers as described above are located adjacently to each other in the direction of the axis of rotation and simultaneously used for a grinding operation. Consequently, the grinding stone layers are worn away to different degrees, and thus a large step is likely to be formed at the joint surface, which is a boundary portion.

SUMMARY OF THE INVENTION

An object of the invention is to provide a grinding wheel that includes a plurality of types of grinding stone layers provided in an axial direction and having different properties, and that is capable of grinding a workpiece W having grinding target portions in different shapes with high finishing accuracy.

According to an aspect of the invention, a grinding wheel includes a disc-like member and a grinding stone layer disposed on an outer peripheral surface of the disc-like member to grind a workpiece. A grinding surface of the grinding stone layer includes a cylinder grinding surface formed parallel with an axis of rotation of the disc-like member, end grinding surfaces formed orthogonally to the axis of rotation and at respective opposite sides of the cylinder grinding surface in a direction of the axis of rotation, and corner grinding surfaces that connect the cylinder grinding surface to the end grinding surfaces such that the grinding surface is curved. The grinding stone layer includes a cylindrical-portion grinding stone layer including a part of the corner grinding surfaces and the cylinder grinding surface and end grinding stone layers including a remaining part of the respective corner grinding surfaces and the respective end grinding surfaces and having a property different from a property of the cylindrical-portion grinding stone layer. Joint surfaces are each formed by joining a boundary surface of the cylindrical-portion grinding stone layer and a boundary surface of the end grinding stone layer such that the boundary surfaces have a preset inclination to the axis of rotation. The joint surfaces are each formed to extend from a predetermined position in the corner grinding surface toward an interior of the grinding stone layer.

As described above, each joint surface between the cylindrical-portion grinding stone layer and the end grinding stone layer is inclined to the axis of rotation and formed to extend from the predetermined position in the corner grinding surface toward the interior of the grinding stone layer. Thus, even when a step extending in a direction orthogonal to the axis of rotation is formed between the cylindrical-portion grinding stone layer, which is likely to be significantly worn away, and the end grinding stone layer, which is only insignificantly worn away, the step is unnoticeable compared to a step that may be formed in the related art because the joint surface is positioned in the corner grinding surface. Consequently, a step transferred to the workpiece to be ground is also unnoticeable, and the workpiece is provided with an accurately ground surface.

The joint surface is inclined to the axis of rotation. Thus, when the grinding surface of the end grinding stone layer is trued, a distance from the grinding surface of the end grinding stone layer to the joint surface is prevented from being constantly reduced for each truing operation. Consequently, the grinding stone in the aspect of the invention can be used over a longer period of time and has a longer life than grinding stones in the related art.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
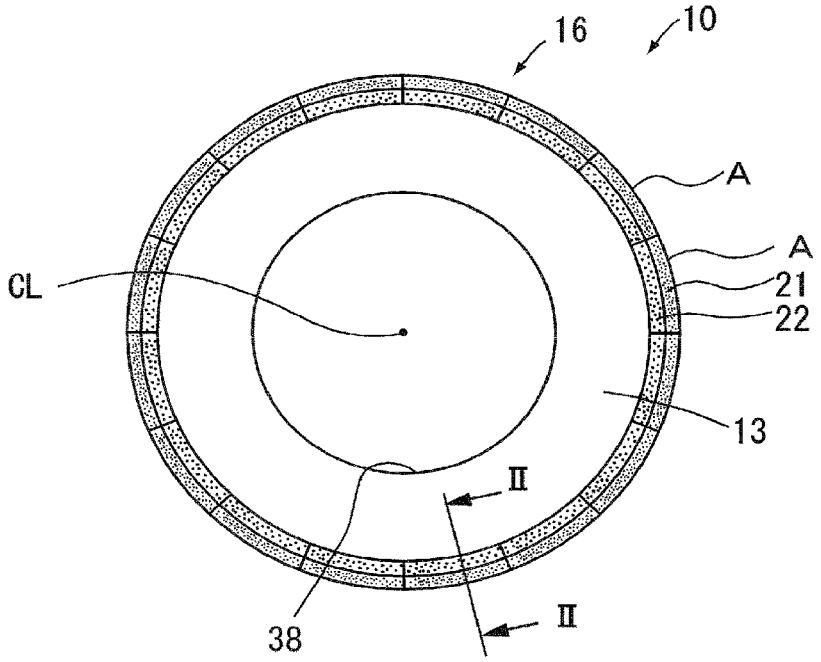
FIG. 1 is a front view depicting a grinding wheel according to an embodiment.

An embodiment of a grinding wheel according to the invention will be described below based on the drawings. As depicted in FIG. 1, a grinding wheel 10 includes a disc-like member 13, and a grinding stone layer 16 disposed on an outer peripheral surface of the disc-like member 13 to grind a workpiece W. The disc-like member 13 is formed by molding metal such as iron or aluminum or resin.

The disc-like member 13 is driven to rotate around an axis of rotation CL of the grinding wheel 10 (in FIG. 1, the axis extends from the drawing plane away from the viewer). The axis of rotation CL referred to below without any special description represents the axis of rotation CL of the grinding wheel 10. The grinding stone layer 16 includes a plurality of (in the present embodiment, 16) circumferential grinding stone chips A formed by dividing the grinding stone layer 16 into 16 equal chips in a circumferential direction. That is, the circumferential grinding stone chips A are also the grinding stone layer 16. The 16 circumferential grinding stone chips A are all the same in shape. In the following description, in connection with description of the grinding stone layer 16, one of the circumferential grinding stone chips A is taken and described as a representative unless the circumstances are exceptional. The grinding wheel 10 is a formed grinding wheel intended to grind a recessed portion formed in an outer periphery of a workpiece W (for example, a crank pin, a journal, or the like for an automotive crank shaft).

Figure 2:
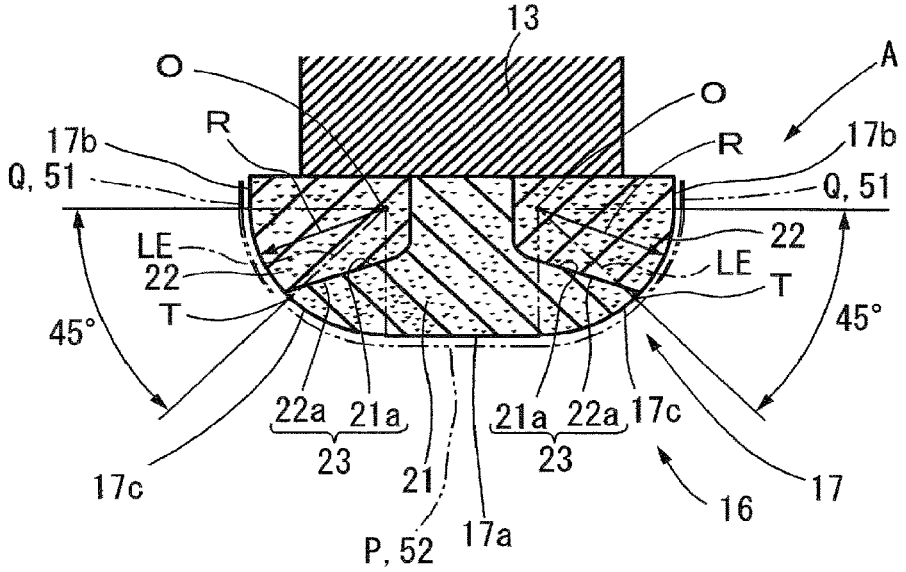
FIG. 2 is a sectional view taken along the line II-II in FIG. 1.

As depicted in FIG. 2, a grinding surface 17 of each of the circumferential grinding stone chips A (grinding stone layer 16) included in the grinding wheel 10 includes a cylinder grinding surface 17*a*, end grinding surfaces 17*b*, and corner grinding surfaces 17*c*. The cylinder grinding surface 17*a* is formed parallel to the axis of rotation CL of the disc-like member 13 to grind a bottom surface 48 of a recessed portion 50 (recessed groove) of the workpiece W depicted in FIG. 5 and FIG. 6. The end grinding surfaces 17*b* are orthogonal to the axis of rotation CL and are formed at the respective opposite sides of the cylinder grinding surface 17*a* in the direction of the axis of rotation CL. The end grinding surfaces 17*b* grind side surfaces 46, 47 of the recessed portion 50 depicted in FIG. 6.

Each of the corner grinding surfaces 17*c* is formed by connecting the cylinder grinding surface 17*a* and each end grinding surface 17*b* together with a curve having a given radius of curvature R, that is, a circular arc-shaped curve. The corner grinding surfaces 17*c* grind round corners 49 (see FIG. 6) of the recessed portion 50 of the workpiece W that connect side surfaces 46, 47 of the recessed portion 50 and a bottom surface 48 of the recessed portion 50 together.

The circumferential grinding stone chip A (grinding stone layer 16) includes one cylindrical-portion grinding stone layer 21 and two end grinding stone layers 22. As depicted in FIG. 2, the cylindrical-portion grinding stone layer 21 includes a part of the corner grinding surfaces 17*c* and the cylinder grinding surface 17*a* (see a range P depicted by a thin long dashed double-short dashed line). The end grinding stone layers 22 include the remaining part of the corner grinding surfaces 17*c* and the end grinding surfaces 17*b* (see ranges Q depicted by a thick long dashed double-short dashed line). A combination of the part of the corner grinding surfaces 17*c* and the cylinder grinding surface 17*a* (range P) included in the cylindrical-portion grinding stone layer 21 is hereinafter sometimes referred to as a second grinding surface 52. A combination of the remaining part of each corner grinding surface 17*c* and each end grinding surface 17*b* (range Q) included in the end grinding stone layer 22 is hereinafter sometimes referred to as a first grinding surface 51. The cylindrical-portion grinding stone layer 21 and each end grinding stone layer 22 are formed to have different properties (this will be described below in detail).

As depicted in FIG. 2, the end grinding stone layers 22 and the cylindrical-portion grinding stone layer 21 are arranged in line in an order of the end grinding stone layer 22, the cylindrical-portion grinding stone layer 21, and the end grinding stone layer 22 in the axial direction from left to right in FIG. 2. Each of the end grinding stone layers 22 includes a boundary surface 22*a* that is in contact with the adjacent cylindrical-portion grinding stone layer 21. The cylindrical-portion grinding stone layer 21 includes boundary surfaces 21*a* that are in contact with the adjacent end grinding stone layers 22. In other words, each of the end grinding stone layers 22 includes the boundary surface 22*a* in a portion thereof adjacent to the cylindrical-portion grinding stone layer 21, which is adjacent to the end grinding stone layer 22 in the direction of the axis of rotation CL. The cylindrical-portion grinding stone layer 21 includes the boundary surfaces 21*a* in respective portions thereof adjacent to the end grinding stone layers 22, which are adjacent to the cylindrical-portion grinding stone layer 21 in the direction of the axis of rotation CL.

The boundary surfaces 22*a*, 21*a* facing each other are joined together to form the circumferential grinding stone chip A. A combination of the boundary surface 22*a* and the boundary surface 21*a* joined together is referred to as a joint surface 23. As described below in detail, in this case, the joint surface 23, particularly a part of the joint surface 23 corresponding to an area where the corner grinding surface 17*c* is formed, is formed to have a preset inclination to the axis of rotation CL. The joint surface 23 referred to below represents this part of the joint surface 23. As depicted in FIG. 2, the joint surfaces 23 are each formed to extend from a predetermined position in the corner grinding surface 17*c* toward the interior of the circumferential grinding stone chip A (grinding stone layer 16). In the present embodiment, the joint surface 23 is formed to include not only a part having a preset inclination to the axis of rotation CL but also a part crossing the axis of rotation CL at right angles inside the grinding stone layer 16. This shape is adopted only to facilitate formation of the grinding stone layer 16. Therefore, the invention is not limited to this form. The joint surface 23 may be formed to include only the part having the preset inclination to the axis of rotation CL.

Each corner grinding surface 17*c* is formed to have a circular arc shape having a predetermined radius of curvature R in a longitudinal section thereof as described above (see FIG. 2 and FIG. 3). A surface position of the joint surface 23 on the corner grinding surface 17*c* is positioned closer to the end grinding surface 17*b* than an intersection position T between the corner grinding surface 17*c* and a line LE passing through a circular arc center O of the corner grinding surfaces 17*c* and extending in a direction at an angle of 45° to the axis of rotation CL. The longitudinal section refers to a radial section of the grinding wheel 10 taken along a surface including the axis of rotation CL. In other words, the sectional view in FIG. 2 taken along the line 11-11 in FIG. 1 also depicts a longitudinal section. The surface position of the joint surface 23 refers to a position where the joint surface 23 is exposed to the exterior of the grinding stone layer 16.

In the above description, the inclination angle $\alpha°$ (see FIG. 3) of the joint surface 23 to the axis of rotation CL can be optionally set. However, the inclination angle $\alpha°$ is preferably set based on a truing amount L1 of each truing operation TL (see a long dashed double-short dashed line in FIG. 3) on the end grinding surface 17*b* of each end grinding stone layer 22. Specifically, the inclination angle α° is preferably determined according to the ratio of the truing amount L1 of each truing operation on the end grinding surface 17*b* to the truing amount L2 of each truing operation on the cylinder grinding surface 17*a* of the cylindrical-portion grinding stone layer 21. In other words, by way of example, when the ratio of L1 to L2 is 3:1, preferably α° is equal to $\tan^{-1}$ (⅓). Consequently, if, for example, truing is continuously performed from right to left in FIG. 3 with the ratio of L1 to L2 kept at 3:1 as depicted by a long dashed double-short dashed line in FIG. 3, a substantially similar relation can be maintained among the end grinding surface 17*b*, the cylinder grinding surface 17*a*, and the joint surface 23. In the present embodiment, the following magnitude relation between L1 and L2 is constantly satisfied: L1>L2. Consequently, the inclination angle α° of the joint surface 23 to the axis of rotation CL is constantly smaller than 45°.

The truing operation TL is a well-known technique for grinding the grinding surface (the first grinding surface 51 and the second grinding surface 52) of the grinding stone that has been roughened to a given degree or higher as a result of a grinding operation on the workpiece W over a predetermined time, in order to correct the surface state to obtain a new surface. Therefore, detailed descriptions are omitted. The truing amounts L1, L2 refer to the depth of cutting with respect to the uncorrected state of the surface of the grinding stone.

Figure 4:
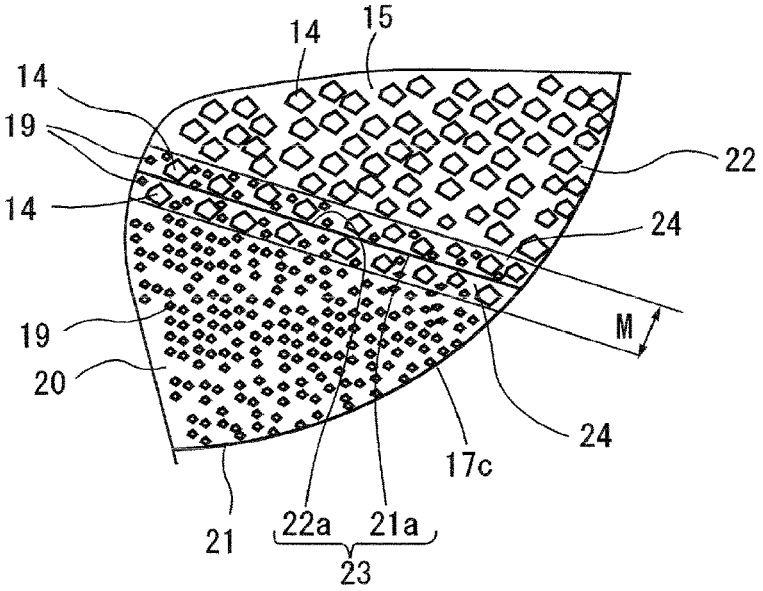
FIG. 4 is an enlarged view of the S portion in FIG. 3, illustrating compositions of grinding stone layers.

As depicted in FIG. 4, each end grinding stone layer 22 is formed, for example, by bonding super-abrasives 14 of CBN, diamond, or the like using a bond 15. The end grinding stone layer 22 is a grinding stone layer that has a high hardness and that is unlikely to be worn away, by way of example.

As depicted in FIG. 4, the cylindrical-portion grinding stone layer 21 is formed, for example, by bonding super-abrasives 19 of CBN, diamond, or the like using a bond 20. By way of example, the cylindrical-portion grinding stone layer 21 is a grinding stone layer in which the grinding stone has a small grain size and which is used for finish grinding. The cylindrical-portion grinding stone layer 21 further has a low hardness and is relatively likely to be worn away. The bonds 15, 20 are, for example, vitrified bonds or resinoid bonds.

Figure 3:
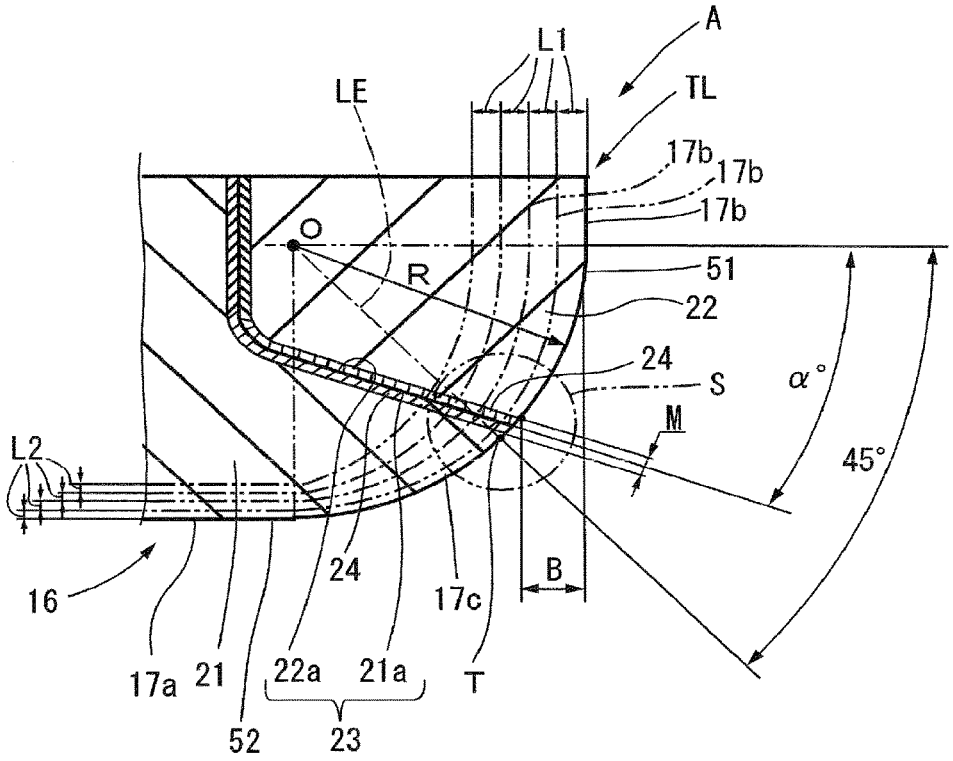
FIG. 3 is a partially enlarged view of FIG. 2.

Although not described above, in the present embodiment, grinding stone layers referred to as mixing portions 24 are formed on both sides of the joint surface 23 on the border between the cylindrical-portion grinding stone layer 21 and each end grinding stone layer 22 as depicted in FIG. 3 that is an enlarged view of FIG. 2. The mixing portions 24 are layers resulting from melting of the bond 15 in the end grinding stone layer 22 and the bond 20 in the cylindrical-portion grinding stone layer 21 when the cylindrical-portion grinding stone layer 21 and the end grinding stone layer 22 are joined together on heating. The mixing portions 24 are grinding stone layer portions containing a substantially even mixture of, for example, CBN grinding grains with a grain size of #800 (super-abrasives 19) and, for example, CBN grinding grains with a grain size of #80 (super-abrasives 14) contained in the end grinding stone layer 22.

The mixing portions 24 contain both the bond 15 and the bond 20 in a mixed manner. Therefore, the mixing portions 24 have the properties of both the end grinding stone layer 22 and the cylindrical-portion grinding stone layer 21. The likelihood of wear of the mixing portions 24 is substantially intermediate between the likelihood of wear of the end grinding stone layer 22 and the likelihood of wear of the cylindrical-portion grinding stone layer 21. In the present embodiment, the mixing portions 24 more preferably have a smaller width M. The width of each of the mixing portions 24 (M/2) preferably enables up to one or two super-abrasives 14, 19 from the end grinding stone layer 22 and the cylindrical-portion grinding stone layer 21 to be contained in the mixing portion 24.

Consequently, an area of the first grinding surface 51 where grinding can be performed using only the composition of the end grinding stone layer 22 corresponds to the entire first grinding surface 51 except for the mixing portion 24 located on the first grinding surface 51 side with respect to the joint surface 23 (the width=M/2). As is the case with the first grinding surface 51, an area of the second grinding surface 52 where grinding can be performed using only the composition of the cylindrical-portion grinding stone layer 21 corresponds to the entire second grinding surface 52 except for the mixing portion 24 located on the second grinding surface 52 side with respect to the joint surface 23 (the width=M/2). The mixing portions 24 may be omitted if the circumferential grinding stone chip A can be produced without the mixing portions 24.

The end grinding stone layers 22, the cylindrical-portion grinding stone layer 21, and the mixing portions 24 form the circumferential grinding stone chip A. The circumferential grinding stone chips A are arranged on the outer peripheral surface of the disc-like member 13 in the circumferential direction to form the grinding stone layer 16.

Now, a manufacturing method for the circumferential grinding stone chip A will be described in brief To manufacture the end grinding stone layers 22, first, powder that is a mixture of the super-abrasives 14, the bond 15, and the like for the end grinding stone layers 22 is pressed using a press machine and molded into grinding stone chips for the end grinding stone layers 22. The press-molded grinding stone chips are dried, and after the drying, the resultant grinding stone chips are sintered to complete the end grinding stone layers 22. The cylindrical-portion grinding stone layer 21 is manufactured by a method similar to the method for manufacturing the end grinding stone layers 22 except that the super-abrasives 14 and the bond 15 for the end grinding stone layers 22 are changed to the super-abrasives 19 and the bond 20 for the cylindrical-portion grinding stone layer 21.

Next, for junction, the end grinding stone layers 22 and the cylindrical-portion grinding stone layer 21 are sintered with the boundary surfaces 22*a*, 21*a* of the end grinding stone layers 22 and the cylindrical-portion grinding stone layer 21 in contact with each other. The bond 15 and the bond 20 are melted near a contact portion between the boundary surfaces 22*a*, 21*a* of the sintered end grinding stone layers 22 and cylindrical-portion grinding stone layer 21. In this state, the super-abrasives 14, 19 from each end grinding stone layer 22 and the cylindrical-portion grinding stone layer 21 are mixed together as described above to form the mixing portions 24 at the respective opposite sides of the joint surface 23, and thus the circumferential grinding stone chips A are formed. The thus formed 16 circumferential grinding stone chips A are consecutively stuck to the outer peripheral surface of the disc-like member 13 all along the circumference thereof with an adhesive (not depicted in the drawings), so that the grinding wheel 10 is formed.

Figure 5:
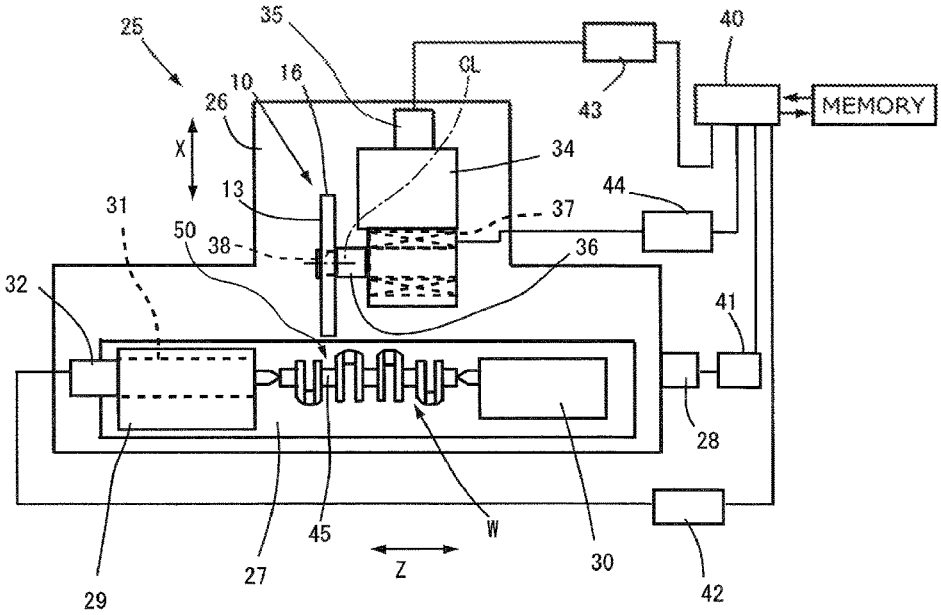
FIG. 5 is a diagram depicting a grinding machine on which the grinding wheel according to the present embodiment is installed.

Now, a grinding machine 25 on which the grinding wheel 10 is installed to grind the workpiece W will be described based on FIG. 5. As depicted in FIG. 5, a table 27 is slidably disposed on a bed 26 and moved in a Z axis direction by a servo motor 28 via a ball screw. On the table 27, a headstock 29 and a tailstock 30 are mounted so as to face each other.

A workpiece W is centrally supported between the headstock 29 and the tailstock 30 in the Z axis direction. A main spindle 31 is rotatably borne on the headstock 29 and rotationally driven by a servo motor 32. The workpiece W is coupled to and rotationally driven by the main spindle 31.

A wheel spindle stock 34 is slidably disposed on the bed 26 and moved in an X axis direction crossing the Z axis at right angles by a servo motor 35 via a ball screw. A wheel spindle 36 is rotatably borne on the wheel spindle stock 34 and rotationally driven by a built-in motor 37. A center hole 38 drilled in the disc-like member 13 of the grinding wheel 10 is fitted over a tip of the wheel spindle 36. The grinding wheel 10 is fixed to the wheel spindle 36 using a bolt.

A CNC apparatus 40 is connected to drive circuits 41 to 44 for the servo motors 28, 32, 35, and the built-in motor 37. The CNC apparatus 40 sequentially executes a grinding NC program during grinding to cause the grinding wheel 10 to grind the workpiece W.

When causing the grinding wheel 10 to grind the workpiece W, the CNC apparatus 40 executes the grinding NC program to output a rotation command to rotate the grinding wheel 10 at a high rotation speed, to the drive circuit 44 for the built-in motor 37. The CNC apparatus 40 outputs a rotation command to rotate the workpiece W at a peripheral velocity suitable for grinding, to the drive circuit 42 for the servo motor 32, which rotationally drives the main spindle 31. Next, a feed command to move the table 27 in the Z axis direction to a position where the workpiece W faces the grinding wheel 10 is output to the drive circuit 41 for the servo motor 28.

When the grinding wheel 10 is placed to face a grinding area of the workpiece W, a command to move the wheel spindle stock 34 in the X axis direction at a roughing feeding speed is output to the drive circuit 43 for the servo motor 35. Thus, the grinding wheel 10 grinds the workpiece W while being fed with coolant through a coolant nozzle not depicted in the drawings.

Now, grinding of the workpiece W by the grinding wheel 10 will be described in detail. As described above, the workpiece W is a crank shaft, and a grinding target area is a recessed portion 50 of the crank shaft, for example, an outer peripheral surface of a crank journal 45 depicted in FIG. 5 and opposite side surfaces 46, 47, in the direction of the axis of rotation, of the crank journal 45 depicted in FIG. 6. The outer peripheral surface of the crank journal 45 and the opposite side surfaces 46, 47 of the crank journal in the direction of the axis of rotation are hereinafter sometimes referred to only as the recessed portion 50. Furthermore, the outer peripheral surface of the crank journal 45 may be considered to be a bottom surface of the recessed portion 50 and referred to as a bottom surface 48.

Figure 6:
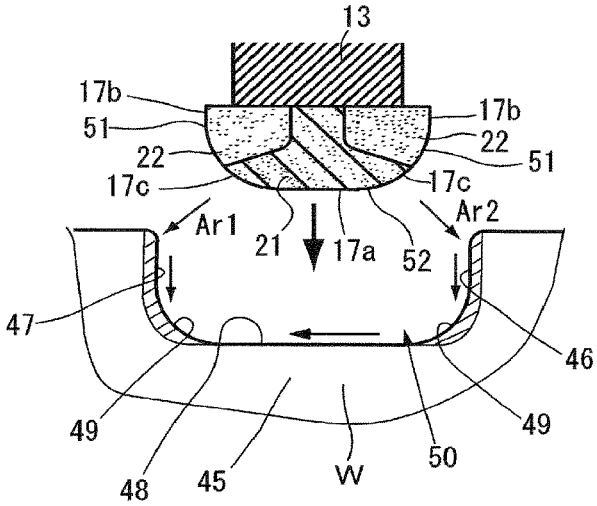
FIG. 6 is a diagram illustrating a relation between the grinding wheel according to the embodiment and a workpiece W.

As depicted in FIG. 6, the grinding wheel 10 includes the formed grinding stone layer 16. The grinding stone layer 16 (circumferential grinding stone chips A) is sized to be able to be housed in the recessed portion 50 in the direction of the axis of rotation CL. Thus, to remove, by grinding, the opposite side surfaces 46, 47 of the recessed portion 50 in the direction of the axis of rotation, the grinding wheel 10 cuts in the recessed portion 50 in the directions of arrows Ar1, Ar2 depicted in FIG. 6. In other words, the grinding wheel 10 removes the opposite side surfaces 46, 47 of the recessed portion 50 using a part of the first grinding surfaces 51 with the end grinding stone layers 22, which are provided at the respective opposite sides in the direction of the axis of rotation CL and which are unlikely to be worn away. When the removal of the side surfaces 46, 47 is ended, the cylinder grinding surface 17*a* (outer peripheral surface) of the grinding wheel 10 reaches the bottom surface 48 of the recessed portion 50 (the outer peripheral surface of the crank journal 45). The cylinder grinding surface 17*a* of the cylindrical-portion grinding stone layer 21, which is likely to be worn away, is traversed in the direction of the axis of rotation CL to perform finish grinding on the bottom surface 48 of the recessed portion 50.

In the grinding stone layer 16 of the grinding wheel 10, the joint surfaces 23 are each formed which corresponds to the boundary between the first grinding surface 51 of the end grinding stone layer 22, which is relatively insignificantly worn away, and the second grinding surface 52 of the cylindrical-portion grinding stone layer 21, which is relatively significantly worn away, as depicted in FIG. 2 and FIG. 3. In other words, the surface position of each joint surface 23 is located closer to the end grinding surface 17*b* than the intersection position T between the corner grinding surface 17*c* and the line LE passing through the circular arc center O of the corner grinding surfaces 17*c* and extending in the direction at an angle of 45° to the axis of rotation CL. The joint surface 23 is formed to extend toward the interior of the grinding stone layer 16 so as to have an inclination angle α° of smaller than 45° to the axis of rotation CL.

Figure 7:
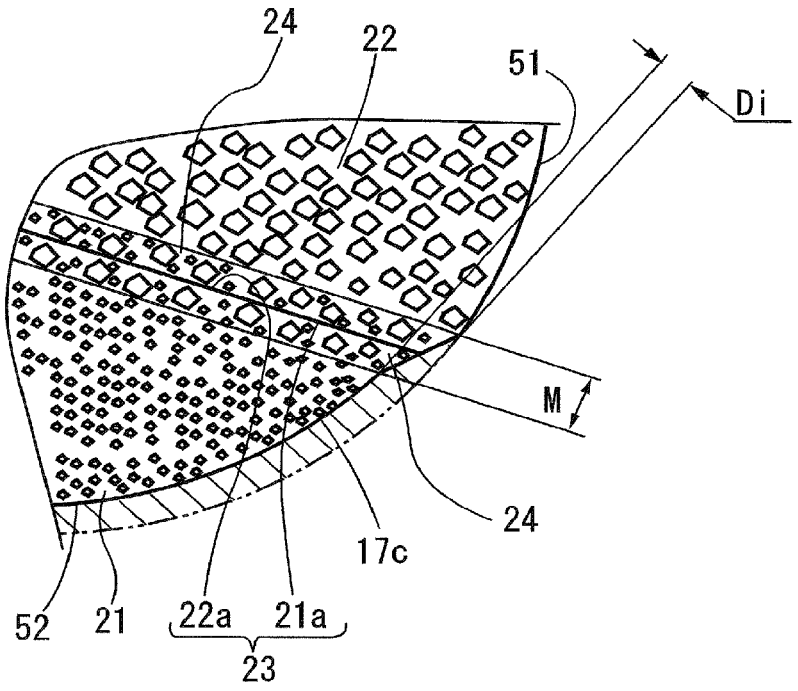
FIG. 7 is a diagram illustrating a step resulting from wear based on FIG. 4.

When the grinding wheel 10 formed as described above grinds the inside of the recessed portion 50, the first grinding surface 51 and the second grinding surface 52, between which the joint surface 23 is sandwiched, are worn away to some extent by grinding resistance offered by the workpiece W. Due to a difference in the amount of wear between the first grinding surface 51 and the second grinding surface 52, a step is formed therebetween. However, the step Di is formed in the corner grinding surface 17*c* and shaped as depicted in FIG. 7 (a shaded part of FIG. 7 represents a worn-away portion of the second grinding surface 52 of the cylindrical-portion grinding stone layer 21, which has produced the step Di). In other words, when the workpiece W is ground using the grinding wheel 10 to which the invention is applied, the step Di formed in the grinding stone layer 16 is not such a noticeable step as formed in a grinding stone layer of a conventional grinding wheel with a joint surface extending in a direction orthogonal to the axis of rotation CL. Consequently, even when the step Di is transferred to the workpiece W, appropriate surface accuracy is achieved.

Now, the effects of the truing operation TL performed on the grinding stone layer 16 during a grinding operation will be described based on FIG. 3. A condition for this truing operation TL is that the ratio of 3:1 is used for the ratio of the truing amount L1 of each truing operation TL1 on the end grinding surface 17*b* of each end grinding stone layer 22 to the truing amount L2 of each truing operation TL2 on the cylinder grinding surface 17*a* of the cylindrical-portion grinding stone layer 21, as described above. Specifically, the truing amount L1 of each truing operation TL1 is, for example, 30 μm. The truing amount L2 of each truing operation TL2 is, for example, 10 μm. This makes the inclination angle α° of the joint surface 23 to the axis of rotation CL equal to $\tan^{-1}(1/3)$.

The surface position of the joint surface 23 is located slightly closer to the end grinding surface 17*b* than the intersection position T between the corner grinding surface 17*c* and the line LE passing through the circular arc center O of the corner grinding surfaces 17*c* and extending in the direction at an angle of 45° to the axis of rotation CL, as described above. The long dashed double-short dashed lines illustrate states of the grinding stone layer 16 after each truing operation TL, namely each truing operation TL1 and each truing operation TL2, performed on the grinding stone layer 16 under the above-described conditions. The long dashed double-short dashed lines illustrate the first grinding surface 51 and the second grinding surface 52 resulting from the first to fourth truing operations from right toward left in FIG. 3.

As seen in FIG. 3, after each truing operation TL, the size of the circular arc of the corner grinding surface 17*c* decreases, whereas a substantially similar relation is maintained among the end grinding stone layer 22, the cylinder grinding surface 17*a*, and the joint surface 23. Consequently, even with a plurality of truing operations TL, the above-described small step Di (see FIG. 7) formed at the joint surface 23 can maintain a similar shape. On the end grinding surface 17*b*, in spite of repeated truing operations TL, a distance B from the end grinding surface 17*b* to the mixing portion 24 formed on the first grinding surface side with respect to the joint surface 23 is kept unchanged for a while due to the inclination of the joint surface 23. That is, while the distance B is maintained, the side surfaces 46, 47 are appropriately ground by the end grinding stone layers 22 (end grinding surfaces 17*b*), which exert a high grinding force.

In the above-described embodiment, the grinding wheel 10 includes the disc-like member 13 and the grinding stone layer 16 disposed on the outer peripheral surface of the disc-like member 13 to grind the workpiece W. The grinding surface of the grinding stone layer 16 includes the cylinder grinding surface 17*a* formed parallel with the axis of rotation CL of the disc-like member 13, the end grinding surfaces 17*b* formed orthogonally to the axis of rotation CL and at the respective opposite sides of the cylinder grinding surface 17*a* in a direction of the axis of rotation CL, and the corner grinding surfaces 17*c* that connect the cylinder grinding surface 17*a* to the end grinding surfaces 17*b* such that the grinding surface is curved. The grinding stone layer 16 includes the cylindrical-portion grinding stone layer 21 including a part of the corner grinding surfaces 17*c* and the cylinder grinding surface 17*a* and the end grinding stone layers 22 including the remaining part of the respective corner grinding surfaces 17*c* and the respective end grinding surfaces 17*b* and having a property different from the property of the cylindrical-portion grinding stone layer 21. The joint surfaces 23 are each formed by joining the boundary surface 21*a* of the cylindrical-portion grinding stone layer 21 and the boundary surface 22*a* of the end grinding stone layer 22 such that the boundary surfaces 21*a*, 22*a* have a preset inclination to the axis of rotation CL. The joint surfaces 23 are each formed to extend from a predetermined position in the corner grinding surface 17*c* toward the interior of the grinding stone layer 16.

As described above, each joint surface 23 between the cylindrical-portion grinding stone layer 21 and the end grinding stone layer 22 is inclined to the axis of rotation CL and formed to extend from the predetermined position in the corner grinding surface 17*c* toward the interior of the grinding stone layer 16. In other words, the joint surface 23 is provided in a portion of the corner grinding surface 17*c* that is close to the surface orthogonal to the axis of rotation CL (the end grinding surface 17*b*) instead of a portion of the corner grinding surface 17*c* that is close to the surface parallel to the axis of rotation CL (the cylinder grinding surface 17*a*). Thus, even when the step Di is formed between the cylindrical-portion grinding stone layer 21, which is significantly worn away, and the end grinding stone layer 22, which is only insignificantly worn away, the step Di is unnoticeable compared to a step that may be formed in the related art in which the joint surface is orthogonal to the axis of rotation. Even if, for example, the end grinding stone layer 22 is more significantly worn away than the cylindrical-portion grinding stone layer 21 as in the related art, the step Di formed between the cylindrical-portion grinding stone layer 21 and the end grinding stone layer 22 is unnoticeable compared to the step that may be formed in the related art. Consequently, the step transferred to the workpiece W to be ground is also unnoticeable, and the workpiece W is provided with an accurately ground surface.

The joint surface 23 is inclined to the axis of rotation CL. Thus, when the truing operation TL is performed on the grinding surfaces of the cylindrical-portion grinding stone layer 21 and the end grinding stone layer 22, the distance from the grinding surface of the end grinding stone layer 22 (the end grinding surface 17*b*) to the joint surface 23 is prevented from being constantly reduced for each truing operation TL. Consequently, the grinding stone in the present embodiment can be used over a longer period of time and has a longer life than grinding stones in the related art.

In spite of a predetermined number of truing operations TL, the inclination of the joint surface 23 is effective for maintaining the same distance from the grinding surface (end grinding surface 17*b*) of each of the end grinding stone layers 22, which grind the side surfaces 46, 47 of the recessed portion 50 of the workpiece W, to the joint surface 23, specifically, the same distance to the mixing portions 24 formed at the respective opposite sides of the joint surface 23 (see B in FIG. 3). This extends the life of the grinding wheel 10.

In the above-described embodiment, the longitudinal section of each of the corner grinding surfaces 17*c* of the grinding stone layer 16 is shaped like a circular arc.

The surface position of each of the joint surfaces 23 on the corner grinding surface 17*c* is located closer to the end grinding surface 17*b* than the intersection position T between the corner grinding surface 17*c* and the line LE passing through the circular arc center O of the corner grinding surfaces 17*c* and extending in the direction at an angle of 45° to the axis of rotation CL. In other words, the surface position of the joint surface 23 lies in a portion of the corner grinding surface 17*c* that is close to a portion thereof orthogonal to the axis of rotation CL instead of a portion of the corner grinding surface 17*c* that is close to a portion thereof parallel to the axis of rotation CL. Consequently, even when a step is formed across the opposite sides of the joint surface 23 in the direction of the axis of rotation CL so as to extend in a direction orthogonal to the axis of rotation CL, the step is unnoticeable.

In the above-described embodiment, the truing amount L2 of each truing operation on the cylindrical-portion grinding stone layer 21 is smaller than the truing amount LA of each truing operation on each end grinding stone layer 22. An angle of the inclination between the axis of rotation CL and each of the joint surfaces 23 is set to be smaller than 45°. As described above, the truing amounts L1, L2 of truing operations on the grinding stone layers 21, 22 are determined based on the amounts of wear of the grinding stone layers 21, 22 for the product to be ground, and the inclination angle $\alpha°$ is set in accordance with the truing amounts L1, L2. Thus, an optimum similar relation is likely to be constantly maintained among each end grinding surface 17*b*, the cylinder grinding surface 17*a*, the corresponding joint surface 23. This facilitates extension of the life of the grinding stone.

In the above-described embodiment, the 16 circumferential grinding stone chips A are arranged in the circumferential direction to form the grinding stone layer 16. However, any number of the circumferential grinding stone chips A may be provided. Alternatively, the grinding stone layer 16 may be integrally formed in the circumferential direction instead of being divided into chips.

In the above-described embodiment, the longitudinal section of each of the corner grinding surfaces 17*c* of the grinding stone layer 16 is shaped like a circular arc. The surface position of the joint surface 23 on the corner grinding surface 17*c* is located closer to the end grinding surface 17*b* than the intersection position T between the corner grinding surface 17*c* and the line passing through the circular arc center O of the corner grinding surfaces 17*c* and extending in the direction at an angle of 45° to the axis of rotation CL. However, the invention is not limited to this aspect. The joint surface 23 may be located at any surface position as long as the surface position lies on the corner grinding surface 17*c*. This also produces effects similar to the effects of the present embodiment.

In the above-described embodiment, the inclination angle $\alpha°$ to the axis of rotation CL is smaller than 45°. However, the invention is not limited to this aspect. The inclination angle $\alpha°$ may be equal to or larger than 45°. This also produces effects similar to the effects of the present embodiment.

What is claimed is:

1. A grinding wheel comprising:

a disc-like member; and a grinding stone layer disposed on an outer peripheral surface of the disc-like member to grind a workpiece; wherein a grinding surface of the grinding stone layer includes:

a cylinder grinding surface formed parallel with an axis of rotation of the disc-like member, end grinding surfaces formed orthogonally to the axis of rotation and at respective opposite sides of the cylinder grinding surface in a direction of the axis of rotation, and corner grinding surfaces, each of which us shaped as a circular arc, wherein the corner grinding surfaces connect the cylinder grinding surface to the end grinding surfaces such that the grinding surface is curved, the grinding stone layer includes:

a cylindrical-portion grinding stone layer including a part of the corner grinding surfaces and the cylinder grinding surface;

end grinding stone layers including a remaining part of the respective corner grinding surfaces and the respective end grinding surfaces and having a property different from a property of the cylindrical-portion grinding stone layer; and a mixing portion having both material of the cylindrical-portion grinding stone layer and material of the end grinding stone layer, joint surfaces each formed by joining a boundary surface of the cylindrical-portion grinding stone layer and a boundary surface of the end grinding stone layer such that the boundary surfaces have a preset inclination to the axis of rotation, wherein the mixing portion incorporated the joint surface and the grinding surface at the mixing portion comprises a step, and the joint surfaces are each formed to extend from a predetermined position in the corner grinding surface toward an interior of the grinding stone layer, wherein a position of the joint surface on each of the corner grinding surfaces is located closer to the end grinding surface than is an intersection position between the corner grinding surface and a line passing through a circular arc center of the corner grinding surface and extending in a direction at an angle of 45° to the axis of rotation, whereby the grinding surface at the respective mixing portion and the step are entirely located on the corner grinding surface.

2. The grinding wheel according to claim 1, wherein a truing amount of each truing operation on the cylindrical-portion grinding stone layer is smaller than a truing amount of each truing operation on each end grinding stone layer, and an angle of the inclination between the axis of rotation and each of the joint surfaces is set to be smaller than 45°.

* * * * *